United States Patent [19]

Spreng

[11] 4,393,605

[45] Jul. 19, 1983

[54] SPORTS SHOE

[76] Inventor: Georg Spreng, Weiherstrasse 10, D-7272 Altensteig, Fed. Rep. of Germany

[21] Appl. No.: 264,803

[22] Filed: May 18, 1981

[30] Foreign Application Priority Data

Nov. 15, 1980 [DE] Fed. Rep. of Germany ..... 3043266

[51] Int. Cl.[3] ..... A43B 5/00; A43B 13/04; A43B 23/00

[52] U.S. Cl. ..... 36/114; 36/45; 36/32 R

[58] Field of Search ..... 36/114, 129, 45, 32 R, 36/59 R, 59 C

[56] References Cited

U.S. PATENT DOCUMENTS

| | | | |
|---|---|---|---|
| 2,928,192 | 3/1960 | Green | 36/32 R |
| 3,807,062 | 4/1974 | Spier | 36/118 |
| 4,067,124 | 1/1978 | Rys-Sikora et al. | 36/45 |
| 4,354,319 | 10/1982 | Block et al. | 36/114 |

*Primary Examiner*—Patrick D. Lawson
*Attorney, Agent, or Firm*—Murray Schaffer

[57] ABSTRACT

A sports shoe having a thick sole and an enclosed upper in which the toe cap is divided by means of articulating hinge joints into several narrow strips each of which enclose an acute angle with respect to longitudinal axis of the shoe. The articulating hinges are approximately parallel to each other and run from the inside edge of the shoe and towards the heel. The sole is provided with grooves running in parallel to and beneath the moving joints.

10 Claims, 8 Drawing Figures

SPORTS SHOE

BACKGROUND OF THE INVENTION

The present invention relates to a sports shoe and, in particular, to a sneaker having a solid, thick, elastic sole and a reinforced upper toe cap.

Such sports shoes have had wide use as running shoes, gym shoes, or the like. They are light, but, nevertheless, provide sufficient support for the foot when running. In general, the upper quarters, i.e. toe and instep areas, and rear portions are formed of leather. Leather while supple is rather sturdy and cannot optimally adapt to the rolling motions of the foot during running. Particularly, the toe cap and the corresponding sole portion are not sufficiently flexible to comfortably roll with the runner.

It is an object of the present invention to provide a sports shoe of the type mentioned which, despite the closed toe cap and the thick sole of solid material, is able to optimally adjust to the rolling motions of the foot during running.

SUMMARY OF THE INVENTION

According to the present invention, the toe cap is divided by means of articulating hinge joints into several narrow strips each of which enclose an acute angle with respect to longitudinal axis of the shoe. The articulating hinges are approximately parallel to each other and run from the inside edge of the shoe and towards the heel. The sole is provided with grooves running in parallel to and beneath the moving joints. The moving joints formed in the upper and grooves in the sole portions of the shoe are, in this manner, optimally adjusted in alignment to the moving joints of the toes and provide the sports shoe, despite the use of solid material, with precisely the freedom of movement in the toe area which is required for the rolling motion of the foot. Running with the sports shoe of the present invention is, therefore, considerably easier. This is particularly of importance for long periods of extended runs such as recreation jogging and/or marathoning.

According to the present invention, the moving joints may be formed by sewing or stitching quilting seams in a unitary upper portion extensive with the toe area. On the other hand, discrete strips of material may be sewn together to form the entire area. In any event, it is preferable to form the toe area (unitary or strip) as a quilted material; that is with a double outer layer between which a filling material is embedded. The partitioning of the toe cap and its structure may, however, also be different, it being only essential that the moving joints be formed in the required alignment.

According to the present invention, the grooves in the sole are formed parallel to and beneath the toe joints and preferably have, in cross section, a circular arc profile and terminate in the lateral edge surfaces of the sole. The grooves preferably should have a width of 0.8 to 1.5 cm.

The moving articulated joints in the area of the toe and the grooves in the sole are arranged preferably at an angle of about 60° to 80°, so as to give greatest consideration to the natural arrangement of the toe joints of the foot, of the wearer.

In this form of construction of the toe cap, it may be formed of leather or similar sturdy material while the sole can be formed of plastic.

According to another embodiment, the rolling motion of the shoe during running may be improved further by providing the sole in both the toe and heel tip areas with pulled-up end sections which merge in a continuous manner convexly with the running surface of the sole.

A slight additional resilience in the heel area of the thick sole may be attained by providing the sole with grooves running transversely (i.e. perpendicularly) across the heel area in front of the convex pulled-up end section.

Full details of the present invention are set forth in the following disclosure and are illustrated in the accompanying drawing.

DESCRIPTION OF PREFERRED EMBODIMENTS

Figure 1:
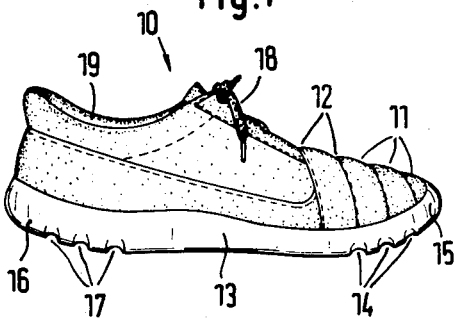
FIG. 1 is an inside elevational view of a left shoe.
Figure 2:
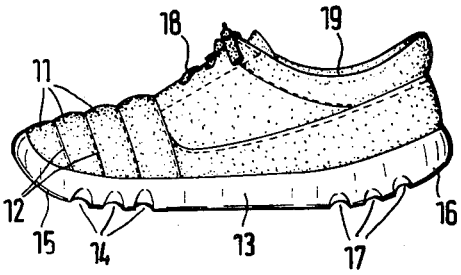
FIG. 2 is an outside elevational view of a left shoe.

As the various views show, the sports shoe 10 is formed of a thick, solid sole of elastic plastic material, although natural or synthetic rubber may be used and a laced enclosed upper of leather or similar sturdy fabric joined in conventional manner to the sole. The upper is provided with a closed toe cap formed in the toe area which merges with the U-shaped lace and instep quarter closing area 18 known per se, and with rear side quarters 19, the latter enclosing the heel with an enlarged welt edge.

According to the present invention, while the materials used for the toe cap and the sole 13 are relatively sturdy and stiff, an optimal adjustment to the rolling movement of the foot when running is, nonetheless, obtained by partitioning the toe cap into several parallel strips 11. This may be done by means of a plurality of articulating joints 12 designed, for example, formed by conventional stitching. The toe cap consists of two plys of leather or fabric between which a filling material such as fiber, non-woven fabric or the like is placed. Such quilted construction provides softness, supplety and cushioning against shock, while at the same time enabling effective articulation of the strips.

It is critical, however, that the joints 12 be arranged so as to run at an acute angle with respect to the longitudinal axis of the shoes running from the inside edge of the sports shoe rearwardly toward the outside edge. In this manner, the joints 12 adapt themselves in their alignment to the shape of the actual toe joints of the foot of the user. The shoe can, therefore, be bent in the same way as the toes of the foot.

The toe cap can also be formed as a plurality of individually fabricated strips which are joined together at their longitudinal edges (the required angle when applied with respect to the shoe) by stitching to provide the articulating hinge. Also, one of the lower or upper layers forming a plurality of strips may be a single piece while the other outer layers may be of individual strips.

In either of these forms, the upper layer of the strips can be made of varying colors or design.

Figure 5:
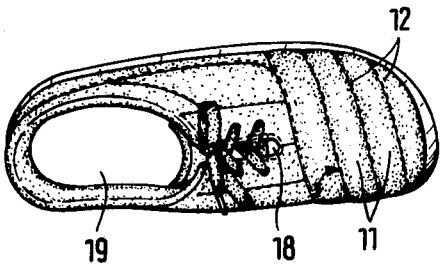
FIG. 5 is a top plan view of a left shoe.
Figure 6:
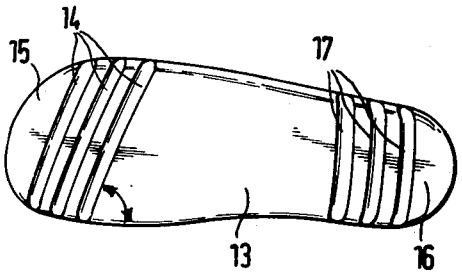
FIG. 6 is a bottom view of a left shoe.

The resilience of the sports shoe 10 is improved still further as a result of the present invention by forming the thick sole 13 with parallel grooves 14 aligned with and located beneath the joints 12. These grooves 14 have, in cross section, a circular arc profile and terminate in the lateral side edges of the sole 13. Their width is preferably selected between 0.8 to 1.5 cm. The number of the joints 12 in the toe cap and the number of grooves 14 in the sole 13 preferably equal and are between 3 to 5. The angle indicated in FIGS. 5 and 6 of the joints 12 and of the grooves 14 is selected at about 60° to 80° and may be selectively adjusted to the shoe size.

Figure 3:
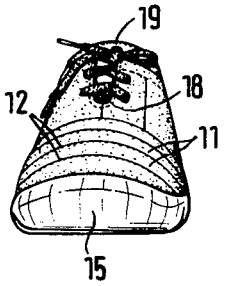
FIG. 3 is a front elevational view of a left shoe.
Figure 4:
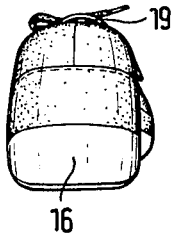
FIG. 4 is a rear elevational view of a left shoe.

In order to improve the rolling motion of the foot during running, the thick sole 13 may be designed with the front rear end sections 15 and 16 respectively pulled convexly upward in the toe and heel area. This serves precisely to improve the rolling of the sports shoe 10 in the starting and end phase of the foot motion as it strikes and leaves on the ground. As evident in the FIG. 3 and 4, these end sections 15 and 16 of the sole 13 are rounded off to merge on the sides and are arched convexly outward with the upper and the upper side parts 19.

The sole 13 may also be provided in the heel area in front of the end section 16 with transversely crossing grooves 17 corresponding in form and size to the grooves 14 in the toe area of the sole 13. These transversely running grooves 17 permit the shoe to adapt to the rolling motion of the heel of the foot also in the heel area, despite the thick sole 13. As a result, one obtains an optimal adjustment of the sports shoe 10 by its deformability to the entire rolling motion of the whole foot during running.

Figure 7:
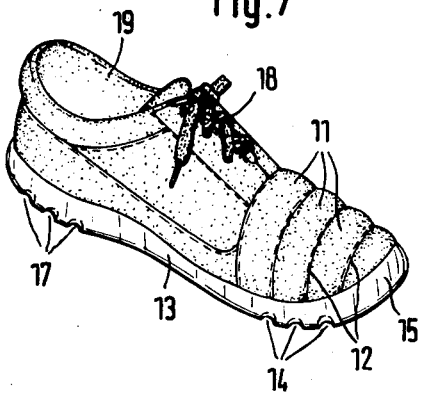
FIG. 7 is a perspective view of the inside of a right shoe.
Figure 8:
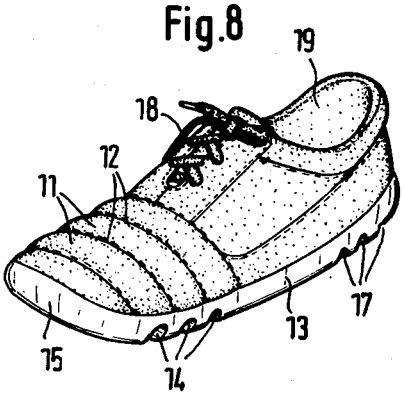
FIG. 8 is a perspective view of the outside of a left shoe.

It only need be mentioned that the shoe for the right foot seen in FIG. 7 is structured identically, the insides of the sports shoes representing the axis of symmetry of a pair.

Various modifications and changes have been suggested and others will be apparent to those skilled in this art. Accordingly it is intended that the present disclosure be taken as illustrated only and not limiting of the present invention.

What is claimed is:

1. A sports shoe having a sole and an enclosing upper, said upper having a toe cap, formed of a plurality of strips, articulatingly interconnected along parallel lines extending from the inside edge toward the heel of said shoe at an acute angle with the longitudinal axis of said shoe, said sole being provided with a plurality of grooves aligned with the articulating interconnections of said strips.

2. The shoe, according to claim 1, wherein said toe cap is made of a unitary sheet and the articulating connections are provided by stitching said sheet.

3. The shoe, according to claim 1, wherein said toe cap is formed of a quilted unitary sheet having an upper and lower layer between which is located a filler and the articulating interconnections are provided by stitching said sheet.

4. The sports shoe, according to claim 1, 2 or 3, wherein that the grooves in the sole have in cross section a circular arc profile in and extend to the lateral edge of the shoe.

5. The sports shoe, according to claim 4, wherein the grooves are about 0.8 to 1.5 cm in width.

6. The sports shoe as defined in claim 1, 2 or 3 wherein the joints in the toe cap area and the grooves in the sole are arranged at an angle of about 60° to 80° to the longitudinal axis of the shoe.

7. The sports shoe, according to claim 1, wherein at least the toe cap is formed of leather and the sole of a plastic material.

8. The sports shoe, according to claim 1, wherein the toe and heel are pulled up and merge convexly with the running surface of the sole.

9. The sports shoe as defined in claim 8, wherein the sole is provided with grooves crossing the heel area in a transverse direction.

10. The sports shoe, according to claim 1, 2 or 3, wherein the number of joints in the toe cap and of the grooves in the sole are equal and about 3 to 5 in number.

* * * * *